United States Patent [19]

Nitchman et al.

[11] Patent Number: 4,531,656

[45] Date of Patent: Jul. 30, 1985

[54] SYSTEM, APPARATUS AND METHOD OF DISPENSING A LIQUID FROM DISPOSABLE CONTAINER AND A CONTAINER THEREFOR

[76] Inventors: Harold L. Nitchman, 1230 Parody, St. Charles, Mo. 63301; William B. Cunningham, Jr., 916 Woodshire, St. Louis, Mo. 63141

[21] Appl. No.: 487,561

[22] Filed: Apr. 22, 1983

Related U.S. Application Data

[63] Continuation-in-part of Ser. No. 439,115, Nov. 4, 1982, , which is a continuation-in-part of Ser. No. 363,511, Apr. 2, 1982, Pat. No. 4,491,247, which is a continuation-in-part of Ser. No. 285,611, Jul. 21, 1981, Pat. No. 4,440,319.

[51] Int. Cl.[3] ..... B67D 5/60; F25J 5/60

[52] U.S. Cl. ..... 222/131; 222/183; 222/396; 215/31

[58] Field of Search ..... 222/39, 64, 66, 105, 222/130, 131, 173, 183, 206, 215, 394, 396, 397, 398, 399, 400.7, 541; 220/69, 3, 19, 401, 410; 215/1 C, 31

[56] References Cited

U.S. PATENT DOCUMENTS

| | | | |
|---|---|---|---|
| 2,294,118 | 8/1942 | Leary | 225/3 |
| 2,400,955 | 5/1946 | Samel | 225/15 |
| 2,673,676 | 3/1954 | Troust | 226/129 |
| 2,756,105 | 7/1956 | Magill | 299/95 |
| 2,766,899 | 10/1956 | Wallace | 215/12 |
| 2,784,882 | 3/1957 | Du Bois | 215/1 C |
| 2,816,691 | 12/1957 | Ward | 222/183 |
| 3,026,005 | 3/1962 | Cook | 222/105 |
| 3,061,129 | 10/1962 | Fitzgerald | 215/11 |
| 3,117,695 | 1/1964 | Cox | 222/105 |
| 3,171,571 | 3/1965 | Daniels | 222/94 |
| 3,191,810 | 6/1965 | Johnston | 222/183 |
| 3,195,779 | 7/1965 | Nicko | 222/82 |
| 3,240,399 | 3/1966 | Frandeen | 222/211 |
| 3,243,084 | 3/1966 | Stegner | 222/95 |
| 3,294,289 | 12/1966 | Bayne et al. | 222/95 |
| 3,349,965 | 10/1967 | Krugger | 222/399 |
| 3,371,822 | 3/1968 | Galloway | 222/95 |
| 3,403,804 | 10/1968 | Colombo | 215/1 C |
| 3,435,990 | 4/1969 | Pike, Jr. | 222/1 |
| 3,589,506 | 6/1971 | Ford et al. | 206/46 |
| 3,752,362 | 8/1973 | Risener | 222/85 |
| 3,768,706 | 1/1973 | Hill | 222/325 |
| 3,876,107 | 4/1975 | Meindl et al. | 222/64 |
| 3,876,115 | 4/1975 | Venus, Jr. et al. | 222/183 |
| 3,945,534 | 3/1976 | Ady | 222/105 |
| 3,964,636 | 6/1976 | Rehrig | 220/306 |
| 4,045,860 | 9/1977 | Winckler | 29/451 |
| 4,247,018 | 1/1981 | Credle | 222/1 |
| 4,265,374 | 5/1981 | Sebalos | 222/95 |
| 4,421,804 | 12/1983 | Mori et al. | 428/35 |
| 4,436,216 | 3/1984 | Chang | 220/69 |

FOREIGN PATENT DOCUMENTS

| | | |
|---|---|---|
| 1268906 | 3/1972 | United Kingdom . |
| 1446338 | 8/1976 | United Kingdom . |

OTHER PUBLICATIONS

"Tapping Instructions BEER SPHERE and Accessories", Johnson Enterprises, Inc., 220 North Fourth Street, Rockford, Illinois.

*Primary Examiner*—Joseph J. Rolla

*Assistant Examiner*—Michael S. Huppert

*Attorney, Agent, or Firm*—Polster, Polster and Lucchesi

[57] ABSTRACT

A system, apparatus, container and method of dispensing a liquid from a disposable container is disclosed. The apparatus includes a cylindrical shroud which receives a filled disposable container; the latter having one or more circumferential rings around its body of a different diameter from that of the container and a mouth. The shroud has a cap assembly which is telescopically received by a lower portion of the shroud with the shroud cap assembly having a stopper for sealingly mating with the container mouth. The shroud with the container therein and with the telescoping shroud cap assembly in place is fitted within a frame which positively prevents axial movement of the telescoping cap assembly relative to the other portion of the shroud beyond a predetermined limit. A range in container lengths may be accommodated and the circumferential rings permit longer containers to be axially compressed as the shroud is inserted in the frame. With the shroud in the frame, the container is internally pressurized via the stopper so that the circumferential rings permit the container to move substantially freely in axial direction so as to insure that the axial force is applied to the ends of the container thereby to insure a good seal is made between the container mouth and the stopper.

10 Claims, 13 Drawing Figures

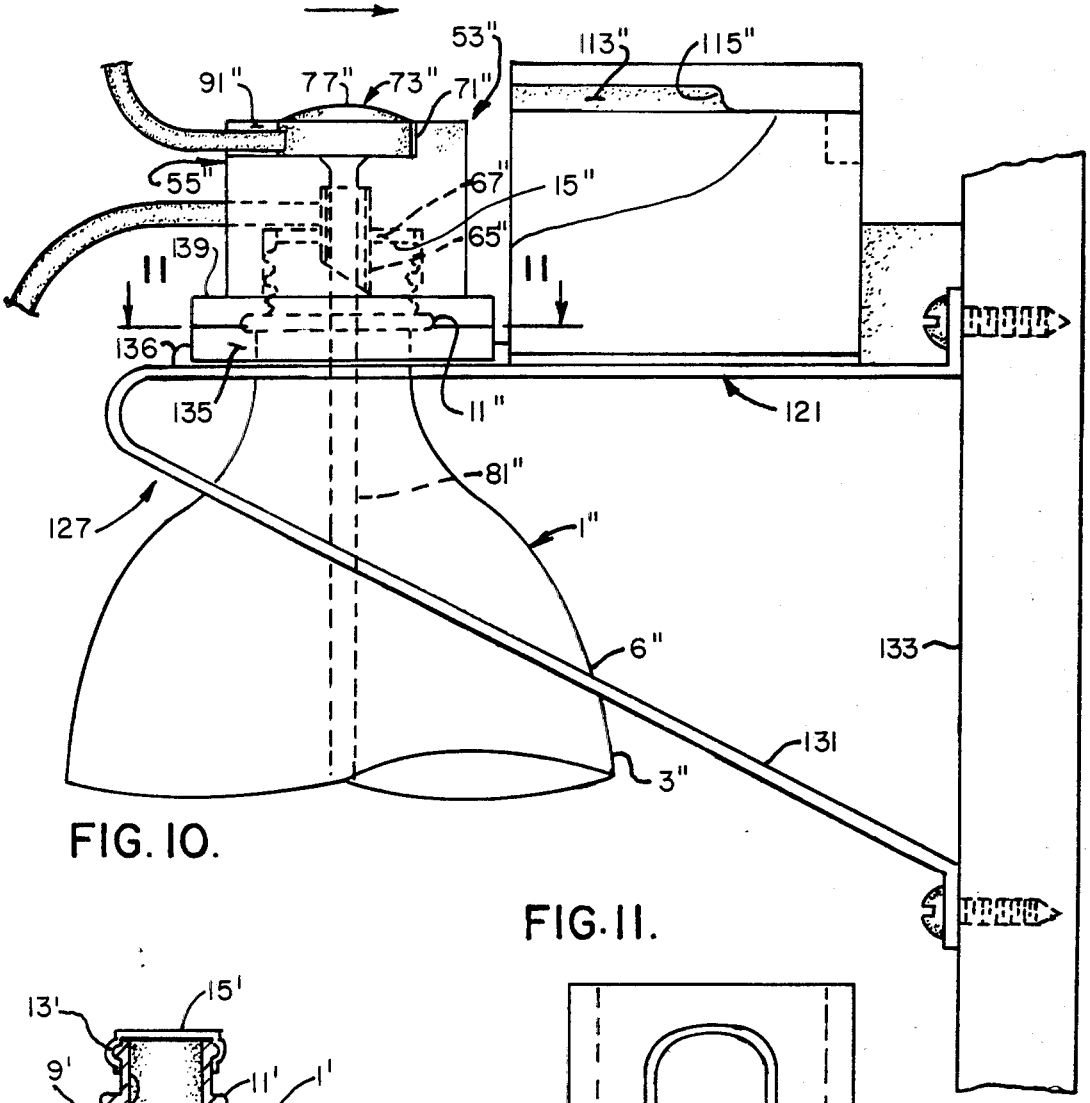
FIG. 10.
FIG. 11.
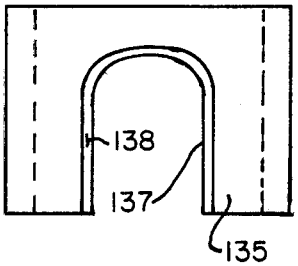
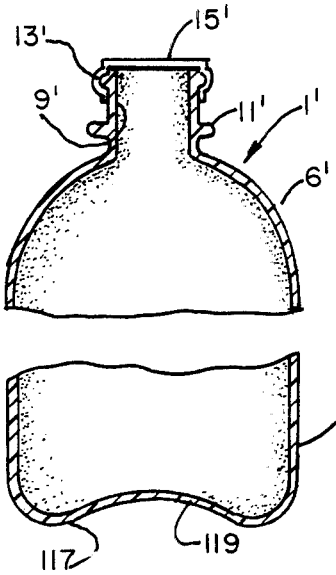
FIG. 7.
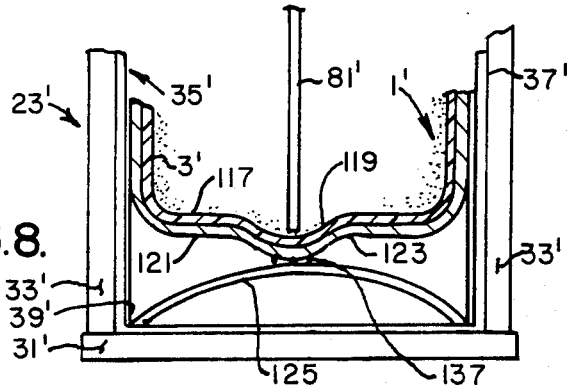
FIG. 8.

SYSTEM, APPARATUS AND METHOD OF DISPENSING A LIQUID FROM DISPOSABLE CONTAINER AND A CONTAINER THEREFOR

CROSS-REFERENCE TO A RELATED APPLICATION

This application is a continuation-in-part of U.S. application Ser. No 439,115, filed Nov. 4, 1982 which in turn is a continuation-in-part of Ser. No. 363,511, filed Apr. 2, 1982, now U.S. Pat. No. 4,491,247 which in turn is a continuation-in-part of U.S. patent application Ser. No. 285,611 filed July 21, 1981, now U.S. Pat. No. 4,440,319.

BACKGROUND OF THE INVENTION

This invention relates to a system, apparatus, and a method of pressure dispensing liquid from a container, and is particularly concerned with the dispensing of a liquid from a disposable or throwaway container in which the liquid within the container is pressurized.

Heretofore, many liquids, such as wine, soft drink syrups, draft beer and the like were pressure dispensed from rigid wall metal containers by internally pressurizing the container with a gas (e.g., carbon dioxide or nitrogen) to a pressure level sufficient to force the liquid from within the container via a diptube to a remotely located dispenser. For example, in a restaurant, a rigid container holding a semi-bulk quantity (e.g., 1–20 liters or more) of wine may be located in a refrigerated cold box and piped to a wine dispensing station conveniently located within the restaurant for ready access by restaurant personnel. In dispensing post mix soft drinks mixed from carbonated water and a concentrated syrup, the syrup is conventionally delivered to the restaurant in rigid metal reusable canisters or tanks. These tanks are typically provided with quick disconnect fittings so as to enable a source of pressurized gas (e.g., carbon dioxide) to be connected to the tank and to pressurize the interior of the tank and the liquid therein. Typically, these tanks contain 5 gallons of concentrate syrup and are constructed so as to withstand a predetermined pressure with an adequate margin of safety.

These prior art reusable metal tanks or kegs were typically of sturdy, metal construction, made of stainless steel or the like, and were consequently expensive. Upon return of these reusable tanks to the soft drink bottling plant, brewery, or winery, it is necessary to sanitize the containers prior to refilling. Also, it was often necessary to repair the quick disconnect fittings and other seals on the container to prevent leakage. Since these containers were reusable, it was necessary for the delivery person not only to deliver filled containers to a customer, but the empty containers must be collected and loaded onto the delivery truck thus resulting in increased time for each delivery stop on the route.

In delivering liquid beverages, such as soft drink syrups, pre-mix soft drinks which are ready for consumption, wine, or draft beer, it is highly desirable that the container be sealed by means of a tamper proof closure. Generally, it is desirable to eliminate a reclosable closure, such as a threaded closure, so as to prevent or inhibit tampering with the container. However, heretofore, the use of a tamperproof closure, such as a crimped in place closure, presented problems in that it required special tools or handling procedures for restaurant personnel to remove the closure prior to dispensing. This added step of removing the tamper proof closure resulted in increased complexity and difficulty for using a system which included such a tamper proof container and required special training and tools for the restaurant personnel.

Still further, it was recognized as a problem that the use of a stopper assembly which could be sealably fitted to a disposable container with the stopper assembly carrying a reusable dip tube which extended down into the bottom of the reusable container presented a problem in that upon removal of the diptube from the container, the diptube would often be coated with and would have a small quantity of the beverage product (e.g., soft drink syrup) thereon. It was necessary to lay the stopper dip tube assembly down while restaurant personnel changed the empty disposable container for a filled container and thus the problem of where to lay the stopper/diptube assembly while changing containers while maintaining the diptube in a sanitary condition presented a problem.

In the blow molding of larger size (e.g., 5 gallon or 19 liter) containers, it is difficult to control the overall length or height of the container to close tolerances. Thus, there arose a need to be able to accommodate a relatively large range of container heights within the apparatus shown in the above-noted oopending U.S. application Ser. Nos. 439,115 and 363,511.

Reference may be made to the following U.S. patents which disclose prior art dispensing apparatus generally in the same field as the instant invention: U.S. Pat. Nos. 3,371,822, 3,589,506, 3,768,706, 3,945,534 and 4,045,860, and to British patent specification Nos. 1,268,906 and 1,446,338.

SUMMARY OF THE INVENTION

Among the several objects and features of the present invention may be noted the provision of a system, apparatus, and method of pressure dispensing a liquid or other flowable material from a disposable, semi-bulk container;

The provision of such a system or method in which a variety of liquids or other flowable fluids may be dispensed from a disposable container under pressure wherein the container is not sufficiently strong to withstand the internal pressurization forces required to pressure dispense the liquid therefrom;

The provision of such a system in which the liquid may be accurately metered as it is dispensed so that predetermined quantities or volumes of the liquid may be readily dispensed;

The provision of such a system which prevents the pressurization of the shipping containers without the shipping container being properly installed in a pressure containment vessel or the like which carries the pressure forces exerted internally within the shipping container upon pressurization of the liquid;

The provision of such a system which does not require personnel utilizing this system to undergo any special training or skills to utilize the system;

The provision of such a system in which the capability of the disposable container to withstand pressurization is not dependent upon the strength of the container and thus eliminates the requirement of using only containers which have adequate strength, even when wet, to withstand the internal pressurization forces;

The provision of such a system in which the container may be made in such manner that it may be shipped empty in a collapsed or knocked-down manner and which may be readily erected for filling thereby saving considerable volume in shipping of the empty continers from the container manufacturer to the party filling the container;

The provision of such a system in which the container remains hermetically sealed until immediately prior to the liquid from therein being in condition to be dispensed;

The provision of such a system which requires a relatively small capital investment for the party filling the containers or for the end user to utilize the system;

The provision of such a system in which substantially all of the liquid is dispensed from the container;

The provision of such a system in which the closure for the disposable container cannot be removed when the container is pressurized;

The provision of such a system in which the contents of the disposable container remain sanitarily sealed within the disposable container and in which the contents are never exposed to the atmosphere prior to dispensing;

The provision of such a system in which a disposable diptube made to be used to dispense the liquid from within the container;

The provision of such a system in which pressure will instantaneously be released from within the container if the container is inadvertently removed from its containment;

The provision of such a system in which pressurization of the container is prevented unless all parts of the system are properly installed;

The provision of such a system, method, and container which enables the use of disposable containers having a relatively wide range or container lengths or heights and yet which insures that the shortest container within this range of heights can be properly sealed to permit dispensing while the longest container within this range may be accommodated; and The provision of such a system which utilizes a container of relatively simple and inexpensive construction thereby to economically permit the container to be disposed of by the end user after use.

Other objects and features of this invention will be in part apparent and in part pointed out hereinafter.

Briefly stated, apparatus of the present invention is intended for dispensing liquid from a disposable container, this disposable container having a mouth. The apparatus comprises means for withstanding pressurization forces exerted on the container upon internal pressurization thereof and the pressure withstanding means comprises a shroud having a first portion for receiving at least in part a portion of the disposable container and having another portion receiving another portion of the disposable container with the shroud portions being axially movable relative to one another. The pressure withstanding means further comprises a frame for receiving the shroud with the disposable container therein, the frame preventing outward axial movement of the shroud portions beyond a predetermined limit. The shroud includes means sealably engagable with the mouth of the disposable container and means for admitting pressurizing gas into the interior of the disposable container and for admitting the dispensing of liquid therefrom. The apparatus further comprises means for accommodating a range of lengths of the disposable container, this last said means permitting a disposable container of a shortest permissible length to be readily sealed relative to said means sealably engagable with said container and permitting a container of a maximum permissible length to be compressed in axial direction as the shroud with the container received therein is inserted within the frame so that upon internal pressurization of the container, a positive seal is made between the means sealably engagable with the container and the container.

The method of this invention relates to dispensing a liquid from a disposable container, the container having a mouth and the container being adapted to be inserted into means for withstanding pressurization forces exerted on the container upon internal pressurization thereof. The pressure withstanding means includes a shroud having a first portion adapted to receive a portion of the disposable container and a second portion adapted to receive another portion of the disposable container with the shroud portions being movable axially relative to one another. The pressure withstanding means further comprises a frame into which the shroud with the disposable container received therein is received for preventing axial outward movement of the shroud portions beyond a predetermined position. The disposable container has a permissible range of overall container length between a permissible minimum length and permissible maximum length. The shroud includes means sealably cooperable with the container mouth. Specifically, the method of this invention comprises the steps of inserting a disposable container into the shroud. In the event the container is longer than the above stated minimum permissible container length, axially compressing the overall length of the container is accomplished and the shroud with the container therein is inserted into the frame. Then, the disposable container is pressurized via the means sealably cooperable with the container mouth thereby to initially cause a seal to be positively made between the container mouth and the last said means. Then, the shroud portions are restrained against outward axial movement relative to the disposable container.

Still further, this invention relates to a container for transporting a liquid, for insertion of the container into a pressure force withstanding means, and for dispensing liquid therefrom upon internal pressurization of the container when installed within the pressure force withstanding means. More specifically, the pressure force withstanding means comprises a shroud having telescopic shroud portions receiving the container and supporting the sides of the container against the pressure forces exerted thereon by internal pressurization of the container. The shroud includes a stopper sealingly cooperable with the container for internal pressurization thereof and for pressure dispensing of liquid therefrom. The pressure force withstanding means comprises a frame for receiving the shroud and for restraining the telescopic shroud portions against axial movement beyond a predetermined outer limit. The container has a base, sidewalls, and a mouth substantially opposite its base, this mouth being sealably cooperable with the stopper. The container has a height from its base to its mouth ranging between a predetermined minimum height and a predetermined maximum height such that the container having a height ranging between the maximum and minimum predetermined heights has its mouth in sealingly cooperable relation with the stopper when the shroud with the container received therein is received within the frame so as to permit internal pressurization of the container. Further, the container has at least one transverse ring around its sidewalls of a different cross-section than its sidewalls thereby to permit the ready axial compression and elongation of the container such that a container having a height greater than the minimum predetermined height but less than or equal to the maximum predetermined height is axially compressed when installed within the telescopic shroud and when the shroud is installed within the frame.

BRIEF DESCRIPTION OF THE DRAWINGS

FIG. 7 is a vertical cross-sectional view of still another disposable container for use in the system and method of the present invention which is particularly adapted for containing and transporting uncarbonated or otherwise unpressurized liquids, this container having a flat bottom;

FIG. 8 is a view of the bottom portion of the dispensing apparatus shown in FIG. 3 modified for use with the container shown in FIG. 7;

FIG. 10 is a side elevational view of the liquid dispensing system illustrated in FIG. 9 with the disposable container and the fitting in its inoperable position permitting the placement of the fitting on the closure of the bottle and permitting the removable thereof, it being understood that the disposable container together with the fitting is slidable in the direction of the arrow shown in FIG. 10 from its retracted position to its operation position in which a fixture forceably cooperates with the removable lid portion of the fitting thereby to effectively seal the removable lid to the diptube so as to permit internal pressurization of the container and further so as to permit the dispensing under pressure of liquid from within the container;

FIG. 11 is a top plan view of the bottom bottle support.

Corresponding reference characters indicate corresponding parts throughout the several views of the drawings.

DESCRIPTION OF PREFERRED EMBODIMENTS

Figure 1:
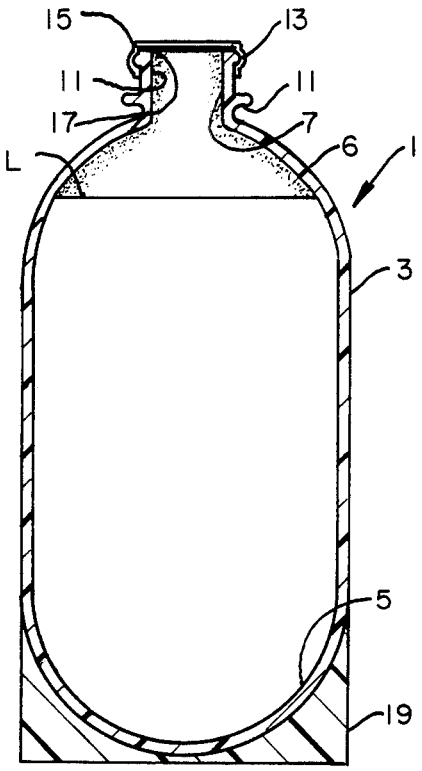
FIG. 1 is a vertical cross-sectional view of a disposable container of the present invention having a supply of liquid hermetically sealed therewithin by means of a tamper proof closure, the container having a mouth sealed by the closure.

As heretofore stated, this specification is a continuation-in-part of U.S. patent application Ser. No. 439,115, filed Nov. 4, 1982 which is a continuation-in-part of U.S. patent application Ser. No. 363,511 filed April 2, 1982 which in turn is a continuation-in-part of U.S. patent application Ser. No. 285,611 filed July 21, 1981. These last two above-mentioned U.S. patent applications are herein incorporated by reference. Because of the length of these previously filed applications, the disclosure of the dispensing systems disclosed therein have been omitted for the sake of brevity. However, in the present specification, a description of the present invention and of the manner of making and using the invention will be provided so as to permit any skilled person in the art to make and use the invention. Thus, certain portions of the disclosures of the above-noted prior patent applications will herein be again disclosed, but for a more complete discussion of the construction of these earlier dispensing systems, reference should be made to the above-described copending patent applications.

Referring now to FIGS. 1–6 of the present specification, a variation of the pressurized liquid dispensing system previously illustrated in FIGS. 28–32 of the aforementioned U.S. patent application Ser. No. 363,511, filed April 2, 1982 will now be explained In FIGS. 1 and 2, a suitable disposable container, as generally indicated at 1, is illustrated for use with the dispensing system and method of the present invention. As illustrated, container 1 is a stretch blowmolded container of semi-bulk capacity (e.g., having a volumetric capacity ranging between about 1 and 20 litres). The container is shown to include cylindrical sidewalls 3, a part spherical bottom 5, and rounded or part-spherical upper shoulders 6 which have a neck 7 integrally formed thereon. The upper end of neck 7 constitutes the mouth 9 of the bottle, the mouth also being referred to as an inlet/outlet opening. Below mouth 9 of the bottle on neck 7, a circumferential support flange or ring 11 is provided. This support ring is optional and may be useful during filling and capping operations of the container. Those familiar with the beverage art will appreciate the utility of support ring 11. Additionally, adjacent the upper end of the neck, a circumferential crimp ring 13 extends outwardly from the neck. As illustrated, a closure cap, as indicated at 15, is sealably secured to the mouth of the bottle and is hermetically sealed thereto by means of a suitable seal 17. As shown, closure cap 15 is a crimped-in-place cap having a portion of which is malleably formed around crimp ring 13 thereby to securely lock the closure cap on the mouth of the bottle thus hermetically sealing the bottle and further preventing opening of the bottle unless the crimped-in-place closure cap is mechanically deformed and removed. It will be appreciated that the provision of such a crimped-in-place closure cap inhibits tampering with the contents of the container 1 until such time as immediately prior to dispensing in accordance with the system and method of the present invention. However, while a tamper-proof closure 15, as above described, may be preferred, it will be appreciated that, within the broader aspects of the present invention, a conventional screw thread cap (not shown) may be used. Additionally, it will be appreciated that either a crimped-in-place cap or a screw cap may be removed from the bottle prior to dispensing in accordance with the system and method of this invention.

As shown in FIG. 1, container 1 is a self-standing bottle having a base cup 19 of suitable synthetic resin foam material or the like such that the base cup not only provides a flat bottom for container 1 such that the container may stand in upright position, but also such that internal pressure forces applied to the interior of the container during dispensing of the liquid from therewithin in accordance with the method of this invention are transmitted outwardly to a pressure containment apparatus, as will be hereinafter disclosed. Alternatively, in FIG. 2, another variation of container 1 is disclosed in which the filled container is placed in a corrugated overcarton for protecting the container during shipment. Because this other container uses overcarton 21, it does not require a base cup. It will be understood that prior to use, the container 1 is removed from overcarton 27.

Figure 2:
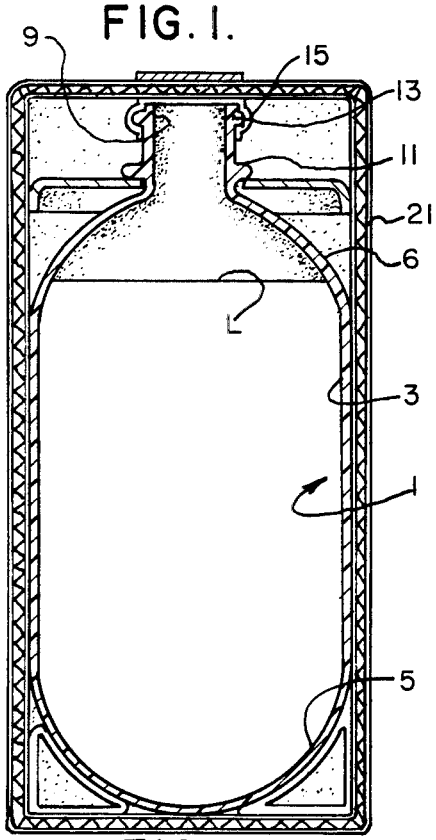
FIG. 2 is another embodiment of a container of the present invention enclosed within an overcarton or shipping carton, as opposed to the self-standing, self-supporting container illustrated in FIG. 1.

Container 1, as illustrated in FIG. 1, is described as being of a suitable synthetic resin material, such as polyester terephthalate (PET). Such resins are conventionally used to stretch blowmold bottles of the general configuration illustrated in FIGS. 1 and 2, albeit of smaller sizes so as to contain carbonated beverages, such as soft drink or beer. More specifically, conventional stretch blowmolded PET containers in sizes ranging between ½ liter and 2 liters are conventionally used for single or multiserving soft drink packages. In the present invention, it is anticipated that a typical container size will range between about 3 and 5 gallons (12 and 20 liters). It will be appreciated by those skilled in the art that these larger size stretch blowmolded PET containers are producable and that they will withstand considerable internal pressurization, such as may be exerted by highly carbonated soft drink beverages, for example, equivalent to 4 atmospheres of carbon dioxide. A typical 5 gallon size stretch blowmolded container generally of the configuration shown in FIG. 1 may have an overall heighth of about 21 inches (53.3 cm.) and a diameter of about 9.5 inches (24 cm.). Additionally, the inside diameter of neck 7 of container 1 may be about 2 inches (5 cm.). It will further be appreciated that the thickness of the walls 3 of container 1, as illustrated in FIGS. 1–3, is greatly exaggerated for purposes of illustration.

It will further be appreciated that in the event the product to be dispensed is not a pressurized or carbonated product, containers of other suitable synthetic resins or films may be utilized in accordance with the system and method of this invention. For example, in dispensing unpressurized or uncarbonated post-mix soft drink syrups, an extrusion blowmolded container, as shown in FIG. 7, of high density polyethylene or the like may be utilized.

Figure 3:
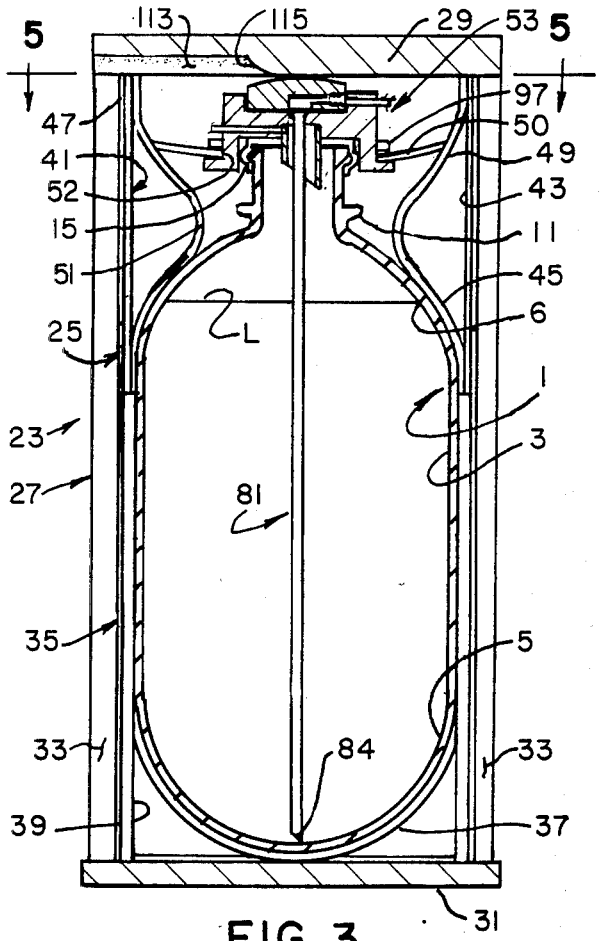
FIG. 3 is a cross-sectional view of a pressure dispensing apparatus of the present invention in which a container either of the type shown in FIG. 1 or in FIG. 2 is received with the pressure dispensing apparatus withstanding substantially all of the pressure loading applied to the container upon internal pressurization thereof and with the apparatus permitting the discharge of liquid from within the container via a removable diptube.
Figure 4:
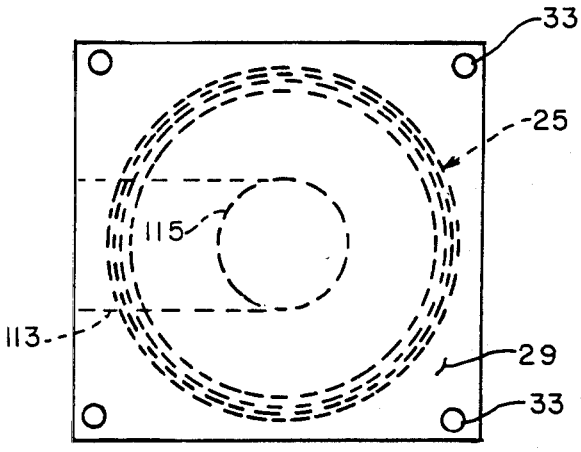
FIG. 4 is a top plan elevational view of the dispensing apparatus shown in FIG. 3.

Referring now to FIGS. 3–6, the system or apparatus of the present invention includes the provision of a pressure withstanding apparatus, as generally indicated at 23, of open construction (i.e., incapable of sealably retaining liquid or gas therewithin unless the liquid is contained in a container 1). More specifically, this apparatus includes a telescopic shroud assembly, as generally indicated at 25, which is slidably movable in horizontal directions relative to a frame assembly, as generally indicated at 27, between an operative position (as shown in FIGS. 3 and 4) in which the telescopic shroud assembly is received within the frame assembly and a withdrawn position (not illustrated) in which the shroud assembly is completely removed from the frame.

More specifically, frame 27 includes an upper headplate 29, a lower headplate 31, and a plurality of tension rods 33 (four are illustrated) extending between and rigidly secured to the upper and lower headplates for holding the headplates in desired spaced apart relation. It will be appreciated that tension rods 33 are selected so as to be able to carry considerable tension loading as may be applied to the endplates upon the shroud assembly being inserted into the frame as illustrated in FIG. 3 and upon container 1 being internally pressurized in accordance with the method of this invention. Further, as illustrated in FIG. 4, tension rods 33 are located at the corners of the upper and lower headplates and are spaced apart a distance somewhat greater than the outer diameter of the shroud assembly 25 thereby to permit the shroud assembly to be readily inserted within and to be removed from the frame without interference from the tension rods. It will be further understood that tension rods 33 may be replaced by other tension carrying means interconnecting the upper and lower headplates. For example, sheet metal webs may be utilized in place of the tension rods to interconnect the upper and lower headplates.

Further, it will be appreciated that a plurality of frame units 27 may be interconnected together in horizontal rows and in vertical columns so as to form a modular unit having the provision of accepting a multiplicity of the telescopic shroud assemblies 25 such that an entire beverage dispensing system capable of simultaneously dispensing a number of different types of beverages and also having the capability of having several of the containers 1 of a particular flavor of beverage hooked in series. This has the advantage that an entire soft drink beverage dispensing system, for example, can be mounted on a wall or supported on the floor and take up a relatively small amount of floor space. For example, a typical beverage dispensing system may require that four flavors of beverage be available for dispensing (e.g., a cola, root beer, orange drink, and a lemon-lime flavor). Also, it may be necessary that the system have four containers of the cola product connected in series such that 20 gallons of the product is available for dispensing at any given time. Such a system may, for example, require eight of the frames 27 integrated into a modular unit such that the unit has two horizontal rows each row including four of the frames 27 with one row of the frames stacked on the other. Such an arrangement would take up only approximately 3 square feet of floor space and yet it would be relatively easy for restaurant personnel to readily change containers in accordance with the system and method of this invention Referring now to FIG. 3, shroud assembly 25 includes a lower shroud portion 35 having a cylindrical outer body and having a female spherical bottom 37 secured (e.g., welded) in place within the cylindrical lower shroud. As is illustrated in FIG. 3, the concave or inner face of the cylindrical bottom faces upwardly and is designed to mate with the outer part spherical surface of bottle 1 with base cup 19 removed. Additionally, the cylindrical shroud 35 has a skirt portion 39 which extends down below the bottom of the spherical female bottom 37 thereby to bear against the upper face of lower headplate 31 of frame 27.

The shroud assembly 25 further includes an upper cap assembly, as indicated generally at 41, which is telescopically received within the upper end of the lower cylindrical shroud 35 with the cap assembly being free to telescopically move in axial direction with respect to the lower cylindrical shroud 35. The upper cap assembly includes a cylindrical wall 43 having a part spherical dome 45 secured (e.g., welded) in its lower end with the inner faces of dome 45 being so structured as to mate with the outer surfaces of the upper shoulder 6 of container 1. The upper end of cylindrical wall 43 extends up above the elevation of mouth 9 of container 1 when the container is inserted in the lower shroud portion and when the upper telescopic cap is telescopically received within the open end of the lower shroud 35 so as to constitute an upper skirt 47. The telescopic cap further includes an inverted dome 49 secured to or integral with lower dome 45 with the upper end of the upper end secured (welded) to the inner face of upper skirt 47. Thus, it will be appreciated that the cylindrical wall 43 together with the domes 45 and 49 secured or welded therewithin form a rugged design even though it is fabricated of relatively thin wall sheet metal or the like. For purposes as will appear, a plate 50 is secured within the upwardly facing concave portion of upper dome 49. At the junction of lower dome 45 and upper dome 49, an opening 51 is defined with the diameter of this opening 51 being sized so as to readily receive neck 7 and support ring 11 (if a support ring is provided) of container 1. Additionally, plate 50 has an opening 52 therewithin for receiving a stopper or fitting assembly, as generally indicated at 53 and as is illustrated in greater detail in FIGS. 5 and 6. It will be appreciated that openings 51 and 52 are generally coaxial relative to the shroud assembly and to container 1 when the container is fitted within the shroud assembly.

In use, with the shroud assembly removed from the frame, and with the upper cap assembly 41 telescopically removed from the lower cylindrical shroud 35, a filled container 1 may be readily lowered into cylindrical shroud 35. It will be recalled that the outer face of the part spherical bottom end 5 of the container mates with the female bottom dome 37 of the cylindrical shroud and, as shown in FIG. 3, the inside diameter of the lower shroud 37 loosely receives but yet accurately centers container 1 within the lower shroud 35 such that the longitudinal axis of the container is generally coaxial with the longitudinal axis of shroud assembly 25. Then, cap 41 may be telescopically fitted into the upper open end of the lower cylindrical shroud 35 thereby aligning fitting assembly 53 with the center of closure cap 15 of container 1 for purposes as will appear.

Figure 5:
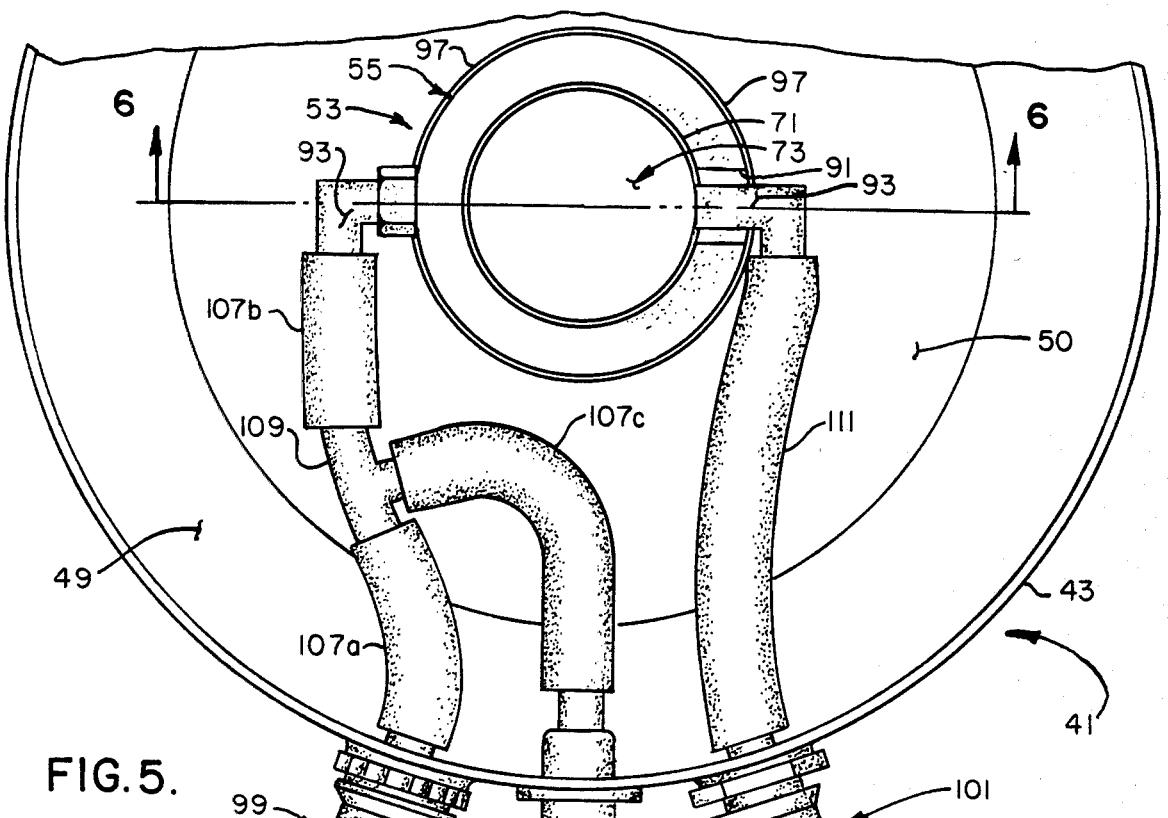
FIG. 5 is a top plan view on a greatly enlarged scale of the dispensing apparatus taken along line 5—5 of FIG. 3 illustrating a top assembly for the shroud portion of the dispensing apparatus which is telescopically received within a cylindrical shroud, the latter receiving the disposable container of either FIG. 1 or FIG. 2, and further illustrating a fitting carried by the top assembly cooperable with the mouth or closure of the disposable container and still further illustrating quick disconnect fittings and tubing for the admittance of pressurized gas into the interior of the disposable container and for permitting liquid from within the disposable container to be dispensed under pressure.
Figure 6:
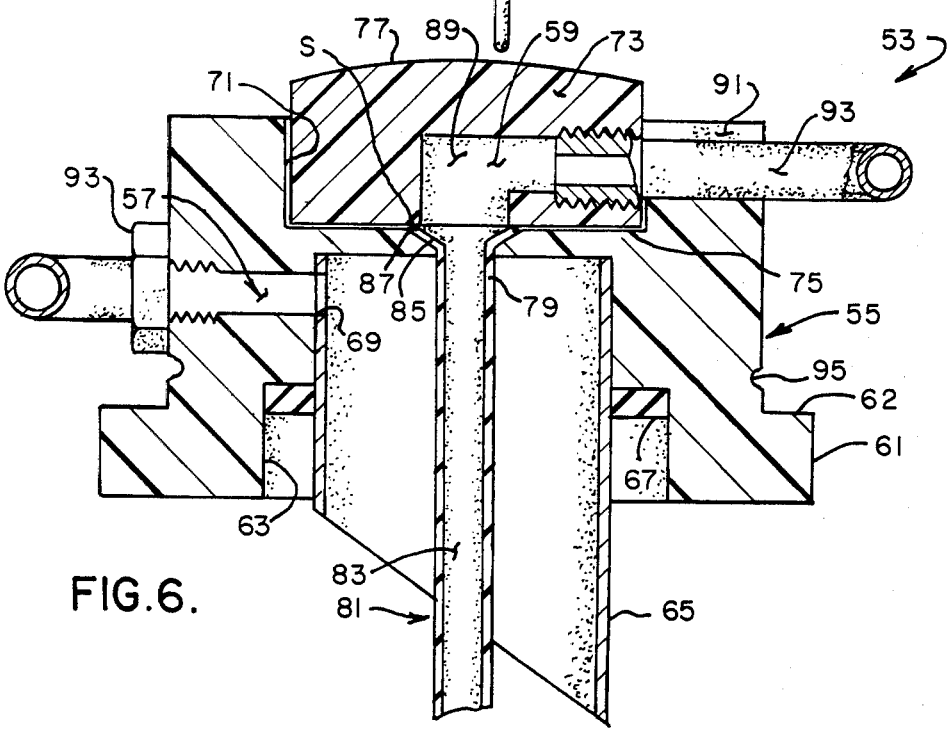
FIG. 6 is a vertical cross-sectional view of the fitting illustrated in FIG. 5 on an enlarged scale illustrating a tube for puncturing the tamper-proof closure of the containers illustrated in FIGS. 1 and 2, illustrating a gas pressurization passage in communication with the interior of the container after the closure has been punctured, and illustrating a liquid dispensing passage adapted to receive a removable diptube and further including a portion of the liquid dispensing passage included within a removable lid which sealably engages the upper end of the diptube thereby to permit the pressurized dispensing of liquid from within the container via the diptube and the liquid dispensing passage without the leakage of either gas or liquid from the disposable container.

Referring now to FIGS. 5 and 6, a more detailed desription of fitting assembly 53 will be provided. As best shown in FIG. 6, fitting assembly 53 includes a body 55 preferably molded of a suitable synthetic resin material. Body 55 is provided with a gas inlet passage, as generally indicated at 57, and with a liquid dispensing passage, as generally indicated at 59. An outwardly extending circumferential flange 61 is provided at the bottom of body 55 with this flange having an upwardly facing shoulder 62 for purposes as will appear. A counterbore 63 is provided in the bottom face of body 55 generally coaxial with body 55. A closure piercing tube, as indicated at 65, is fixably mounted within counterbore 63 and a gasket 67 surrounds the piercing tube for sealingly engaging the outer face of closure cap 15 of container 1 as is best illustrated in FIG. 3. It will be appreciated that the closure piercing tube 65 is a hollow tube, for example 0.75 inch (19 mm.) stainless steel tubing which is either molded in place within body 55 or which is sealably bonded to the body. An aperture 69 is provided at the upper end of the piercing tube in communication with gas inlet passage 57. As will be explained in greater detail hereinafter, with container 1 inserted into the lower shroud 35, with the telescopic cap assembly 41 received within the open end of the lower shroud, piercing tube 65 is centered relative to closure cap 15 of container 1 and the lower, pointed end of the piercing tube bears on the upper surface of the closure cap. By manually forcing the telescopic cap 41 downwardly into the lower cylindrical shroud 35, the piercing tube will readily puncture closure cap 15 thereby providing communication with the interior of container 1 and the interior of the hollow piercing tube. The outer surface of the closure cap will be received within counterbore 63 and will sealably mate with gasket 67.

Fitting body 55 further has a top counterbore 71 therein generally coaxial with bottom counterbore 63. A removable lid, as generally indicated at 73, fits loosely within top counterbore 71 and the lid has a bottom face 75 and a domed top face 77. Liquid dispensing passage 59 in fitting 53 is shown to include an aperture 79 providing communication between bottom counterbore 63 and top counterbore 71 with aperture 79 being coaxial with the longitudinal centerline of body 55 and with tube 65. A removable and preferably disposable diptube, as generally indicated at 81, is received by liquid aperture 79. Preferably, diptube 81 is made of an inexpensive synthetic resin material, such as polyethylene or the like, and has an elongate hollow tubular body 83. As shown in FIG. 3, the bottom end of diptube 81 can be serrated so as to prevent the bottom edge of the diptube from sealably engaging the inner surface of container 1 thereby preventing liquid from being dispensed via the diptube. The diptube further has a flared upper end, as indicated at 85. Fitting body 55 has a beveled or countersunk face 87 surrounding aperture 79 so as to sealably mate with the outer surface of the diptube flare 85. The diptube flare 85 serves the dual function of accurately locating the diptube relative to stopper body 55 so that with the stopper body properly inserted into container 1, with the piercing tube 65 inserted through the closure cap 15, and with the closure cap sealably engaging gasket 67, the premeasured diptube 81 will extend fully to the bottom of container 1 thereby to insure that substantially all of the liquid within the container may be dispensed via the diptube. Further, the flared end 85 of the diptube 81 constitutes an integral seal with both the portion of fitting body 55 surrounding aperture 79 and with the bottom face 75 of fitting lid 73.

Liquid dispensing passage 59 in lid 73 further includes a downwardly facing aperture 89 in the center of the lid adapted to be in register with the opening of diptube 81 when the diptube is installed within fitting body 55 and when lid 73 is inserted in the top counterbore 71 in the fitting body. Fitting body 55 further includes a notch 91, as best illustrated in FIG. 5, at one side of the fitting body. An elbow fitting 93 of stainless steel or the like is carried by lid 73 and is in communication with liquid dispensing passage 59 so that with fitting 53 installed on container 1, as heretofore described, and with lid 73 forced downwardly within top counterbore 71 so as to make a seal S between the lid, the flared end of the diptube and countersunk surface 87 of fitting body 55, the liquid contents L of the container will be dispensed upwardly through the hollow diptube and will flow into liquid dispensing passage 59 and out of fitting 53 via elbow fitting 93.

As best shown in FIG. 6, fitting body 55 has a snap ring groove 95 formed therein above the level of shoulder 62 of flange 61. It will be appreciated that the cylindrical portion of body 65 is of a diameter somewhat less than the diameter than the central opening 52 in plate 50. Thus, with fitting 53 inserted up through opening 51 between the upper and lower domes 45 and 49 such that shoulder 62 bears against the bottom of plate 50, the cylindrical portion of body 55 extends above the level of plate 50. Upon the installation of a snap ring 97 in snap ring groove 95, fitting 53 is held captive relative to plate 50 and flange 61 engageable with plate 50 positively prevents upward movement of the fitting relative to plate 50 and relative to the telescopic cap assembly 41.

As best shown in FIG. 5, telescopic cap assembly 41 includes a gas inlet quick disconnect fitting, as generally indicated at 99, and a liquid outlet quick disconnect fitting, as generally indicated at 101, both of the quick disconnect fittings being rigidly secured to cylindrical wall 43. It will be understood that these quick disconnect fittings are conventional parts that may be purchased from a variety of manufacturers. Preferably, in a soft drink beverage dispensing system, these quick disconnect fittings 99 and 101 are interchangeable with respective gas and liquid quick disconnect fittings conventionally used on metal transfer tanks. However, it will be understood that for dispensing other liquids, such as beer, other quick disconnect fittings may be utilized. Generally, fittings 99 and 101 are mechanically different such that the gas pressurization and liquid dispensing hoses cannot be inadvertently connected to the wrong fitting.

Between quick disconnect fittings 99 and 101, a combination safety pressure relief/pressure release valve, as indicated at 103, is provided so as to relieve pressure from within container 1 in the event pressure within the container exceeds a predetermined level (e.g., 130 psig). Additionally, by pulling finger ring 105, pressure may be manually released from within the container.

Quick disconnect fitting 99 is interconnected with gas inlet fitting 93 in communication with gas inlet passage 57 by means of flexible tubing sections **107*a*, 107*b* with a tee connector 109 therebetween. Another flexible tubing section 107*c* is provided between pressure relief valve 103 and tee 109. In this manner, gas pressure may be readily admitted into the interior of the container via gas passage 57 and aperture 69 within closure piercing tube 65, and further pressure relief valve 103 is placed in communication with the gas pressure within the container. Another length of flexible hose, as indicated at 111, interconnects the liquid quick disconnect fitting 101 with elbow fitting 93 carried by removable lid 73. It will be appreciated that flexible tubing 111 serves the dual purpose of providing communication between the outlet elbow fitting 93 and quick disconnect fitting 101 and also serves the function as a tether so as to readily permit removable lid 73 to be manually removed from within top counterbore 71 of fitting body 55** and to prevent the lid from becoming lost during changeover of one container with another.

As heretofore described, a filled container 1 is lowered into position within cylindrical shroud portion 35 and the telescopic cap assembly 41 is inserted in the open mouth of the cylindrical shroud. This aligns piercing tube 65 carried by fitting 53 with the center of closure cap 15 of the container. The cap assembly is telescopically lowered within the cylindrical shroud 37 until the sharpened end of the piercing tube 65 engages the closure cap 15. Then, the user of the system manually pushes downwardly on either fitting 53 or on the upper edges of cylindrical wall 43 thereby to force piercing tube to puncture through the closure cap and thus provide communication between the interior of the piercing tube and the interior of the container. It will be appreciated that until such time as closure cap 15 is punctured, which is usually only a matter of a few seconds before the system is ready to dispense, container 1 remains hermetically sealed by closure cap 15. As piercing tube 65 punctures closure 15, a portion of the closure is cut away, but preferably remains attached to the closure. With removable lid 73 moved clear of the top counterbore 71 of fitting body 55, diptube 81 may be inserted through center aperture 79 such that the flared sealing end 85 of the diptube bears against the countersunk surface 87 of fitting body 55. Then, lid 73 is moved into register with top counterbore 71 and is lowered therewithin such that the bottom face of the lid bears against the upper surface of the flared end 85 of the diptube.

Then, as shown in FIG. 3, shroud assembly 25 is slid sidewise into frame 25. It will be understood that as the shroud is initially slid sideways into the frame, the domed top 77 of lid 73 is in register with a groove 113 provided in the inner face of upper head plate 29. As the telescopic shroud assembly 25 moves to its centered position relative to frame 27, a cam face 115 at the end of groove 113 cammingly engage domed head 77 of lid 73 thereby to forceably drive lid 73 downwardly within top counterbore 71 of fitting body 55 so as to positively seal the removable lid relative to the bottom face of the lid and further so as to seal the diptube relative to the countersunk face 87 of fitting body 55. Thus, it will be appreciated that until such time as telescopic shroud 25 is substantially centered within frame 27 such that cam face 115 is engaged with the domed top 77 of removable lid 73, there is no seal between the diptube and fitting 53 and thus it would not be possible to internally pressurize container 1. Further, it will be appreciated that because fitting 53 is sealingly cooperable with container 1 only when shroud 25 is properly centered within frame 27 and since gasket 67 of fitting 53 is sealingly held in place on the mouth of the container (i.e., on closure 15) only by frame 27, it would not be possible to pressurize container 1 unless the container is properly installed within telescopic shroud 25 and unless the shroud is properly installed with frame 27.

With the container properly installed within shroud 25 and with the shroud installed within frame 27, as illustrated in FIG. 3, one then connects a source of compressed gas (e.g., a regulated supply of carbon dioxide) to quick disconnect fitting 99. The compressed gas will enter the container by means of gas passage 57 and by aperture 69 and will flow around the exterior of diptube 81 into the interior of container 1 thereby to exert internal pressure on the container and on the liquid L therein. The internal pressure forces on the container cause it to expand outwardly in all directions. It will be appreciated that the circumferential or hoop stresses exerted on the container by internal pressurization thereof are effectively withstood by the cylindrical walls of the lower shroud portion 35. Further, it will be understood that the spherical bottom 37 within the lower shroud mates with the spherical bottom 5 of container 1 (as shown in FIG. 3) and effectively transfers the pressure forces exerted on the bottom of the container to shroud portion 37. Likewise, the pressure forces exerted on the upper shoulder 6 of the bottle are effectively transferred to the upper telescopic shroud assembly 41 by means of the lower dome 45. However, because the shroud cap 41 is telescopically received within the lower cylindrical shroud 37, the two shroud portions are free to move axially relative to one another. These shroud portions will thus move axially apart from one another until the upper and lower edges of the skirts 39 and 47 bear against the inner faces of upper and lower headplates 29 and 31 at which point further outward axial movement of the shroud portions is positively prevented. Thus, the telescopic shroud in cooperation with frame 27 effectively withstands both circumferential and axial loadings applied to container 1 upon internal pressurization thereof even in the event container 1 is not capable of withstanding any substantial amount of internal pressurization or in the event that the pressure applied to the inside of the container is in excess of its internal pressure withstanding capability.

As will be appreciated, even upon internal pressurization of container 1 at a relatively low pressure level (e.g., 1–4 psig), a substantial axial load is transferred from the container to the telescopic shroud portions 35 and 41 and must be restrained by end plates 29 and 31 and by tension rods 33. This substantial loading of the end plates, even at relatively low pressure levels, requires a large force to be applied to the shroud to slide it sideways out of the frame. Even at these relatively low pressure loadings, the force required to overcome the friction of the telescopic shroud on the end plates exceeds the force that can be ordinarily applied to the shroud by manual means. Of course, as the pressure force within the container increases, more axial loading is transferred to the frame and thus the force required to slide the shroud sideways out of the frame increases proportionately. However, in the event one were to slide the shroud sideways out of the frame, it will be appreciated that as the shroud moves from its centered position as shown in FIG. 3, and as lid 73 moves clear of cam surface 115 provided in the inner face of upper headplate 29, the lid will be free to move upwardly under pressure thus breaking the seal between the lid and the flared end 85 of the diptube thus automatically depressurizing the container.

Also, because the shroud portions 37 and 41 are free to telescopically move in axial direction relative to one another, variations in the overall length of container 1 can be readily accommodated, particularly as explained hereinafter.

In operation, when it is desired to change an empty container 1 for a full one, one merely removes the hoses (not shown) connected to quick disconnect fittings 99 and 103 and pulls finger ring 105 thereby to release pressure from within container 1 via safety relief/pressure release valve 103. When the internal pressure has been entirely relieved from within container 1, shroud 25 may be readily slid sidewise (i.e., to the left as shown in FIG. 3) out of frame 27. Telescopic cap assembly 41 may then be lifted clear of the lower cylindrical shroud portion 37 and the empty container 1 may be removed from the shroud A filled container is then inserted into the cylindrical shroud, the telescopic cap is again fitted within the cylindrical shroud portion and piercing tube 65 is forced through closure cap 15 of the filled container in the manner described. A new disposable diptube 81 is inserted into aperture 79 and removable cap 73 is placed within top counterbore 71. Then the shroud with the filled container therein is slid sideways into the frame to its operating position and the gas supply and liquid dispensing hoses are connected to their respected quick disconnect fittings 99 and 103 thereby to again internally pressurize the filled container 1 and to permit dispensing of the liquid from within the container.

As viewed in FIG. 4, it will be noted, as shown in dotted lines, that shroud 27 engages the inner faces of end plates 29 and 31 along a circular line of contact adjacent tension rods 33. Because of this circular line of contact adjacent the outer edges of the support plates and adjacent the tension rods, the axial loading applied to the end plates imposes a relatively low bending moment on the end plates, as compared with a uniformly distributed load across the diameter of the shroud.

Referring now to FIGS. 7 and 8, an alternative disposable container is illustrated for use in the dispensing system of the present invention. This alternative container, as is generally indicated by 1', is shown to be an extrusion blow molded container of a suitable synthetic resin material, such as high density polyethylene or the like. Generally, this container 1' may be of the same shape and configuration as container 1 heretofore disclosed and illustrated in FIGS. 1 and 2. It will be understood that the "primed" reference characters in FIGS. 7 and 8 indicate parts of both the container, the shroud, and frame of the dispensing apparatus and system of this invention having a similar construction and function as the corresponding parts heretofore described in regard to FIGS. 1–6.

More specifically, container 1', being made of high density polyethylene material or the like, is generally intended to contain uncarbonated (or unpressurized) liquid, such as soft drink syrups or the like. As shown, container 1' has a generally flat bottom 117 with a dimple 119 located centrally on the bottom and projecting upwardly, inwardly of the bottle. It will be appreciated that the container 1' with the flat bottom 117 does not need a base cup, as does bottle 1 in FIG. 1, so as to permit it to stand vertically. As mentioned, closure cap 15' and the remainder of the bottle 1' are generally similar to the construction and operation of the bottle 1 heretofore described and thus these details of the bottle will not herein be described in detail.

Referring now to FIG. 8, a modified version of pressure withstanding apparatus of this invention is indicated generally at 23'. In FIG. 8, only the bottom portion of the pressure dispensing apparatus is illustrated and it will be understood that the remainder of the apparatus and its operation are essentially identical to the apparatus heretofore described. The primary difference between pressure dispensing apparatus 23' and pressure dispensing apparatus 23 is the configuration and construction of the lower portion of the cylindrical shroud 35'. In FIG. 8, shroud 35' is shown to include a base member 121 having an inner surface adapted to mate with the rounded bottom corners and the flat bottom 117 of container 1'. However, it will be appreciated that the provision of the inwardly projecting dimple 119 in bottle 1' could present a problem upon pressure dispensing utilizing a center diptube in that a considerable quantity (e.g., several fluid ounces) of liquid may remain in the container due to the inwardly extending dimple. To overcome this problem, base member 121 is provided with a centrally located concave cavity 123 generally in register with the inwardly extending dimple 119 of the bottle. Further, a dome member 125 is secured (e.g., welded) to the lower portion of skirt 39' and is further welded, as indicated at 127, to the concave cavity 123 formed in base member 121 thereby to strengthen the base member and to assist the base member in withstanding internal pressure forces transferred from the container 1' to the base member. It will be understood that a similar dispensing apparatus may be utilized for dispensing from bottle 1, as shown in FIG. 1, having base cup 19 thereon.

In use, container 1' and pressure dispensing apparatus 23' is similar to the operation and use of container 1 and dispensing apparatus 23 heretofore described. However, it will be appreciated that when container 1' is lowered into cylindric shroud 35', the flat base 117 of container 1' mates with base member 121 of the shroud. It will further be understood that diptube 81' may be somewhat longer than the overall distance from the location of the countersunk surface 87' of fitting body 55' prior to internal pressurization of the body such that the bottom end of diptube 81' bears against the initially inwardly projecting dimple 119. However, upon admitting gas pressure to the interior of bottle 1', even a relatively low level of pressurization, will cause the initially inwardly projecting dimple 119 to buckle over center from its initially inward convex configuration (as shown in FIG. 7) to a concave configuration (as shown in FIG. 8) in which the outer surfaces of the dimple are supported by the concave cavity 123 and base member 121. As shown in FIG. 8, the length of diptube 81' is such that it extends downwardly into the now concave cavity and thus insures that substantially all of the liquid product within container 1' can be pressure dispensed.

Figure 12:
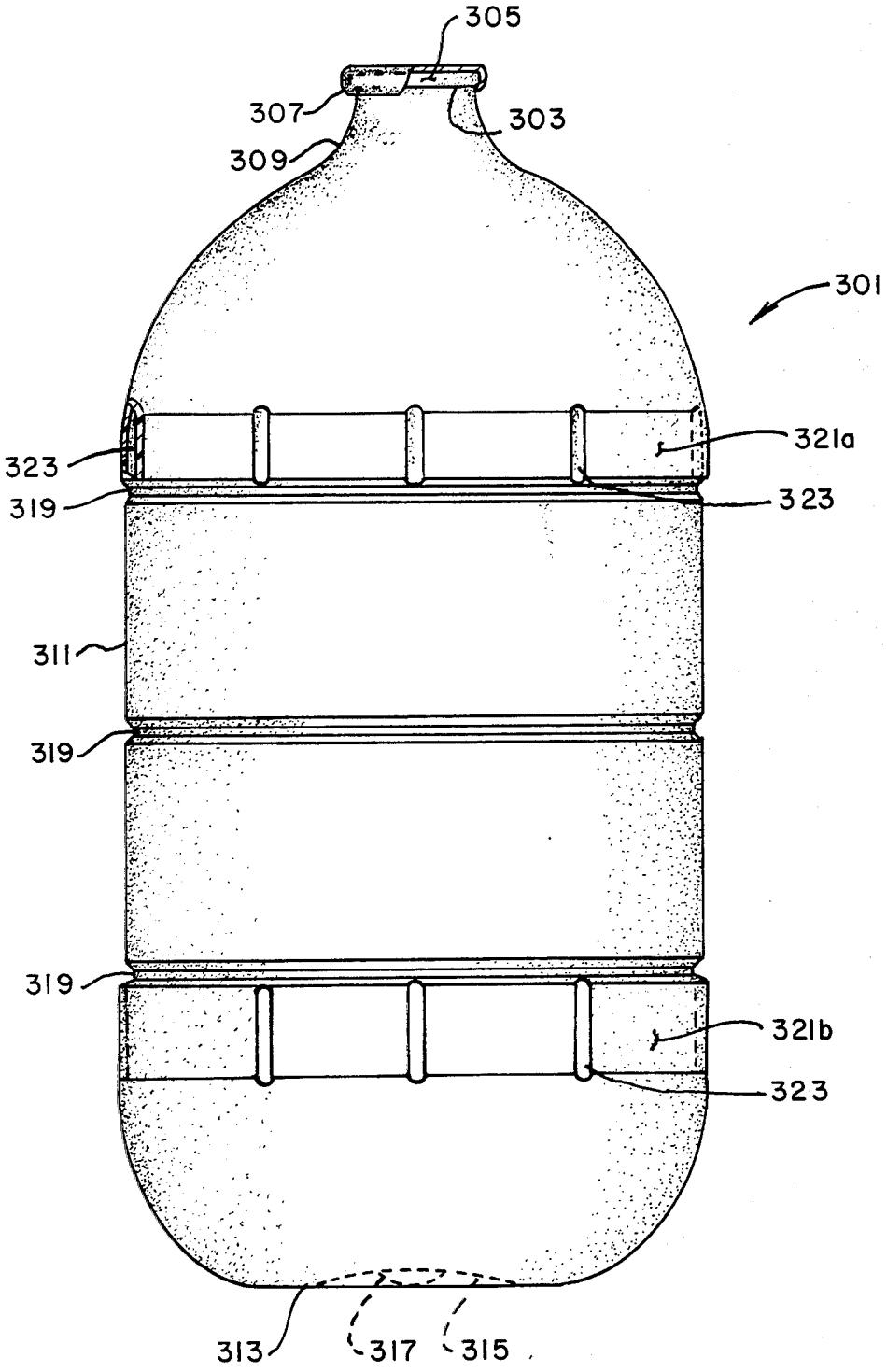
FIG. 12 is an elevational view of still another disposable container similar to that shown in FIG. 7.
Figure 13:
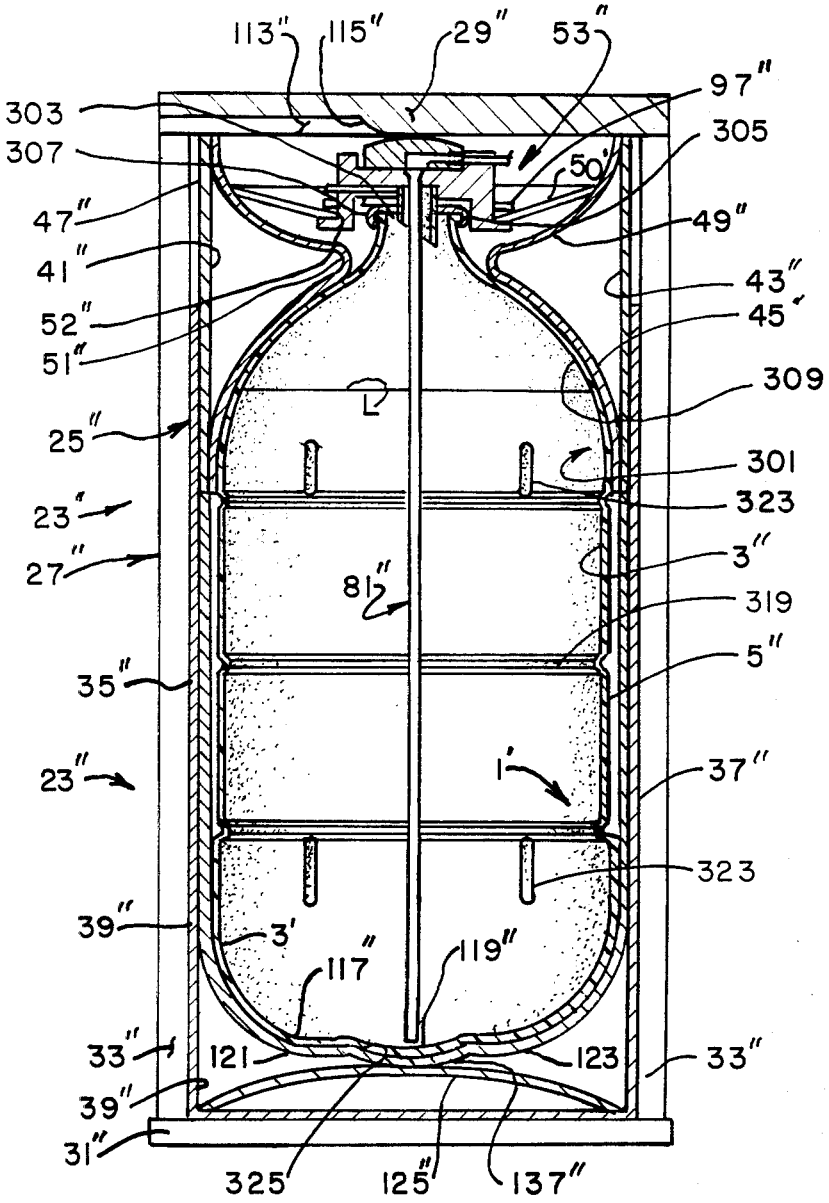
FIG. 13 is a cross-sectional view of the apparatus generally similar to FIG. 3 using the container of FIG. 12.

Referring now to FIG. 12 and 13, another disposable container, as indicated in its entirety by reference character 301, is illustrated for use in the dispensing system and method of the present invention. Container 301 is shown to be a bottle of a suitable synthetic resin material, such as high density polyethylene, and may, for example, be blow molded. The bottle may, in one configuration, have an overall height of about 19.7 inches (55.0 cm.), a diameter of about 10.0 inches (25.4 cm.), and a volume of 5 gallons (19.6 liters), and a weight ranging between about 230–400 grams when molded of high density polyethylene. Bottle 301 is shown to have a centrally located inlet/outlet opening or mouth 303 having an integrally molded clamp ring 305 to which a crimped-in-place closure 307 may be sealably secured thereby to hermetically close and seal the bottle. A neck 309 of part-spherical shape blends into a generally cylindrical bottle body 311.

The bottom of bottle 301 has a flat bearing surface 313 so that the bottle may stand erect without the necessity of a base cup. Further, the bottom of the bottle has a concave inward center portion 315 which has a convex outward center dimple 317. A plurality of circumferential rings 319 are formed on bottle body 311. These rings are shown to have a different (i.e., lesser) diameter than bottle body 311 and facilitate axial elongation or compression of bottle 301 for purposes as will appear.

Above and below bottle body 311, an upper and a lower shoulder **321*a*, 321*b*, respectively, is provided with the outer diameter of the shoulders being somewhat greater than the outer diameter of bottle body 311. Preferably, shoulders 321*a*, 321*b* have a diameter such that the bottle has a somewhat loose, but sliding, sealing fit within its shroud body 37'' (see FIG. 13) when bottle 301 is inserted therein. Further, shoulders 321*a*, 321*b* are provided with a plurality of longitudinal slots 323 therein which serve as air escape passages as the bottle is inserted into its shroud body 37'' so as to enable the controlled escape of air from within the shroud as the bottle is inserted therein thereby to permit the rapid insertion of the bottle within the shroud, but yet so as to prevent the bottle from freely falling within the shroud. For example, for a bottle 301 having the dimensions as above described and for a shroud body 37'' having a height of about 18 inches (45.7 cm), the time required for bottle 301 to be inserted into the shroud body under its own weight may vary between about 0.5–4 seconds, depending on the fit of shoulder 321*a*, 321*b* on the shroud and the combined cross-sectional areas of slots 323**.

In FIG. 13, it is seen that shroud body 37'' is especially adapted to receive and to mate with the lower portions of bottle 301. The "double primed" reference characters in FIG. 13 indicate parts in FIG. 13 having a corresponding construction and function as parts heretofore described. A concave depression 325 is provided in the bottom of shroud body 37'' so as to receive bottle dimple 317 upon the internal pressurization of the bottle in the manner heretofore described so as to cause the inwardly projecting bottle bottom 315 to flatten out against the bottom of the shroud body and so as to permit dimple 317 to move downwardly into depression 325 thereby to form a well generally in register with the lower end of diptube 31 thus insuring that virtually all of the liquid within the bottle will be dispensed.

In accordance with this invention, circumferential rings 319 facilitate the ready axial compression and elongation of bottle 301. It will be appreciated by those skilled in the bottle manufacturing art that the overall length of a bottle, such as shown in FIG. 12, is difficult to hold within close tolerances. It will be appreciated that since the seal between closure 307 on bottle mouth 303 and gasket 67 in stopper assembly 53 is dependent, in large degree, to the overall axial length of the bottle. Thus, if it were necessary to control the overall length of bottle 301 to close tolerances (e.g., ±0.0625 inches, 1.6 mm. or less), the manufacturing costs for bottle 301 would increase substantially. In a manner as will hereinafter be explained, circumferential rings 319 together with telescoping shroud 35'' constitute means for accommodating disposable bottles having a relatively wide range of tolerances in overall length from one bottle to the next. For example, in accordance with the disposable container of the present invention, as illustrated in FIG. 12, it is possible to accommodate various bottles differing in overall length by about 0.25 inches (6.4 mm.) or more, and yet still insure that a positive seal is readily made between closure 307 and gasket 67 of stopper assembly 53 when the shortest bottle within the above-stated range of overall lengths is used and so as to insure that with the longest bottle within the range installed within the shroud, the shroud can be readily inserted into the frame.

Referring to FIG. 13, it will be appreciated that the distance between the inner faces of upper headplate 29'' and lower headplate 31'' of frame 27'' is such that when a bottle 301 having the shortest overall length within the above-stated tolerance range is utilized, seal 67'' on stopper 53'' will make positive sealing engagement with closure 307 (or mouth 303 if the closure is removed) upon initial internal pressurization of the bottle. Further, in the event a bottle 301 is utilized having the longest permissible overall length within the above-stated range of bottle lengths, the user of the apparatus of the present invention need merely exert a downward force on telescopic cap assembly 41'' as the shroud 35'' is inserted into frame 27'' thereby to axially compress the longer bottle 301. It will be understood that the circumferential rings 319 will readily deform in axial compression so as to permit the overall compression of bottle 301. Of course, upon internal pressurization of the bottle, a positive seal is made between closure 307 and stopper gasket 67''.

It will be further understood that upon internal pressurization of the bottle within the shroud, bottle body 311 and circumferential rings 319 together with longitudinal slots 323 will expand radially outwardly until they come into bearing engagement with the inner surfaces of the shroud and thus the entire surface of bottle 301 in contact with the shroud is supported thereby such that the shroud withstands substantially all of the internal pressure forces exerted on the bottle during pressurization thereof.

Further, upon removal of bottle 301 from shroud body 37'', it will be appreciated that longitudinal slots 323 permit air to readily enter the shroud beneath the bottom 313 of the bottle as the shroud is withdrawn thereby permitting easy withdrawal of the bottle.

Figure 9:
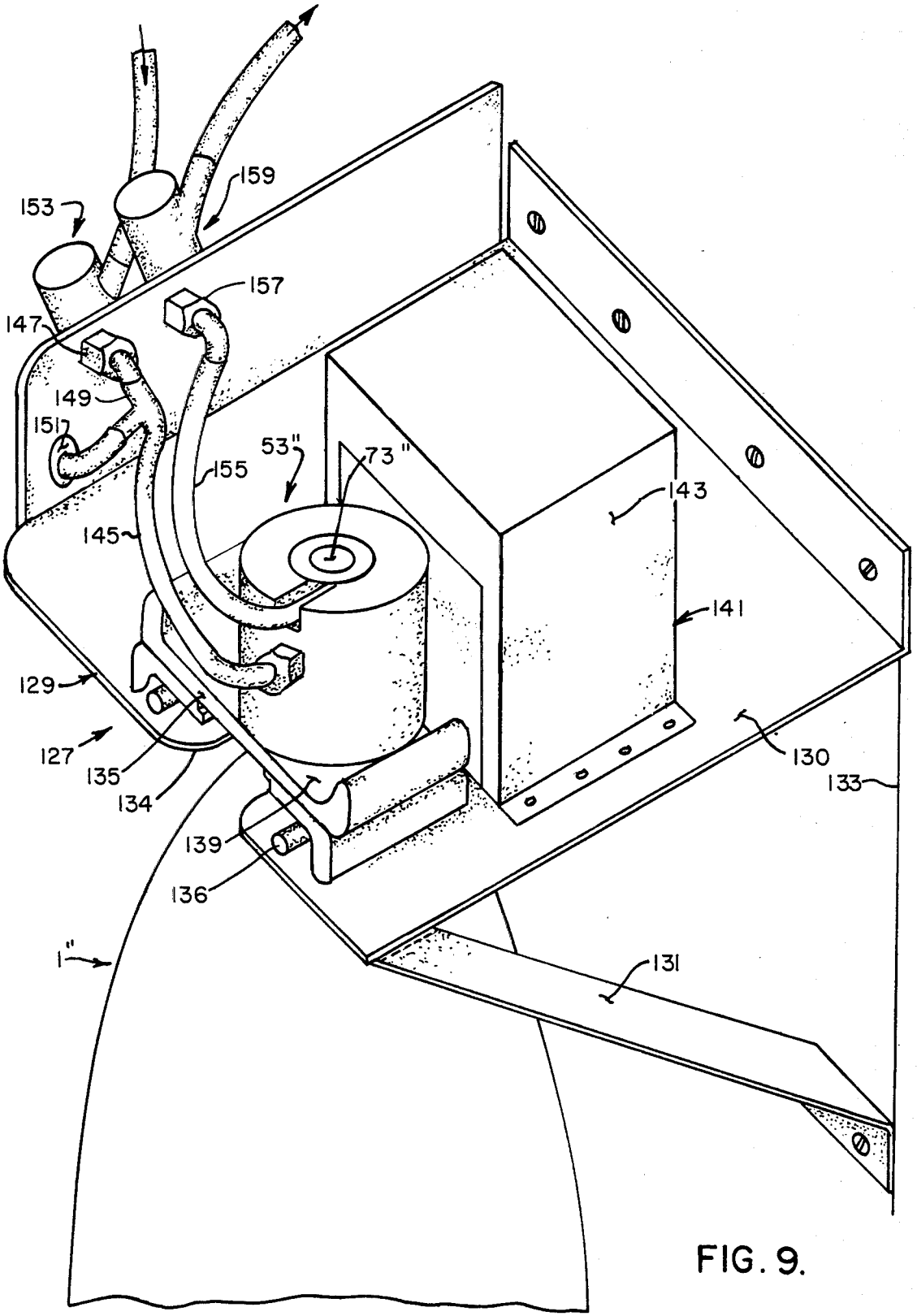
FIG. 9 is a perspective view of another embodiment of the liquid dispensing system of the present invention in which the disposable container has sufficient pressure withstanding capability to permit internal pressurization thereof with an adequate margin of safety and further illustrating a fitting for supporting the disposable container in a desired position and for permitting cooperation between a fitting and the closure of the disposable container with the fitting being generally similar to the fitting shown in FIGS. 5 and 6.

Referring now to FIGS. 9–11, still another embodiment of the liquid dispensing system of the present invention is illustrated and is indicated in its entirety by reference character 127. In many respects, liquid dispensing system 127 is similar in construction and in operation to the liquid dispensing system heretofore described in that a disposable container is internally pressurized so as to permit the pressurized dispensing of liquid from within the container. Liquid dispensing system 127 utilizes a fitting which punctures the closure cap of the disposable container immediately prior to installation of the container within the dispensing apparatus so as to maintain the contents of the container in a sanitary and sealed condition. Still further, this alternative dispensing system 127 is similar to dispensing system 1 in that while the container is internally pressurized, it is not possible to manually remove the container from the dispensing apparatus while the container is internally pressurized. Also, like with system heretofore described, it is not possible to pressurize the disposable container used in conjunction with system 127 unless the container and fitting are properly installed More specifically, the container intended for use with dispensing system 127 is shown in FIGS. 9 and 10 to be indicated in its entirety by reference character 1''. Preferably, this container 1'' is of a suitable synthetic resin material such that it will withstand a substantial internal working pressure therwithin with an adequate margin of safety. Preferably, but not necessarily, container 1'' is of a somewhat smaller volume, for example, ranging between 1 and 2 liters, than container 1 heretofore disclosed which, as previously stated, may contain 20 liters or more. For example, bottle 1'' may be a stretch blow molded container of polyester terephthalate (PET) having sufficient wall thickness so as to withstand a maximum pressure of a magnitude similar to conventional 2 liter multiserving PET carbonated beverage bottles now in wide commercial use. Typically, these beverage bottles are designed to withstand normal operating pressures equivalent to 4 atmospheres of carbon dioxide dissolved within the beverage and have an ultimate pressure withstanding capability ranging between about 150–200 psig. For example, the liquid dispensed by the liquid dispensing system 127 could be an alcoholic beverage, such as bourbon, scotch, gin, or vodka, and that the dispensing system 127 would be utilized in a liquor portion control dispensing system.

More specifically, bottle 1'' is of a generally similar construction to bottle 1 heretofore described and corresponding reference characters indicated by the "double prime" marks indicate corresponding parts of bottle 1'' as are present on bottle 1. Thus, a detailed description of bottle 1'' is not necessary.

Dispensing system 127 comprises a support for bottle 1'', as indicated at 129, which includes a horizontal plate 130 supported by a pair of spaced brackets 131 affixed to wall 133. Plate 130 has a blind notch 134 in its front face of sufficient width to readily receive the neck 7'' of bottle 1'' below support ring 11'' thereof with the bottle extending downwardly below plate 130 between brackets 131. It will be noted that since bottle 1'' has sufficient strength so as to withstand normal internal operating pressures within the bottle with a sufficient margin of safety, a shroud need not be provided for the bottle.

As indicated at 135, a lower bottle support is slidably mounted on a track 136 for sliding movement of the lower support along the track between a loading position (as shown in FIGS. 9 and 10) and a dispensing position (not shown). More specifically, the lower bottle support 135 has a blind notch 137 therein having a bearing shoulder 138 recessed down from the upper planar surface of the lower bottle support with the bottom face of support ring 11'' of the bottle 1'' adapted to rest on shoulder 138. With bottle 1'' hermetically closed by its closure cap 15'', the neck of the bottle is inserted into slot 134 of plate 130 and into notch 137 of the lower bottle support 135 so that the bottle hangs from the support ring 11'' which bears on shoulder 138.

Then, an upper bottle support member, as indicated at 139, is applied to the lower bottle support 135, as shown in FIGS. 9 and 10. The upper bottle support 139 includes a fitting 53'' of generally similar construction and operation to the fitting 53 shown in detail in FIGS. 3, 5 and 6 and heretofore described in detail Therefore, fitting 53'' will not, for the sake of brevity, be again described, but it will be understood that corresponding reference characters indicate corresponding parts between fittings 53'' and 53. With the upper end of the bottle neck 7'' being received in counterbore 63'' of fitting 53'', the user manually presses downwardly on fitting 53'' thereby to forceably puncture closure cap 15'' on bottle 1'' by means of the piercing tube 65''. Then a removable diptube 81'' is inserted in aperture 79'' of fitting body 55'' in the manner heretofore described and the removable lid 73'' is fitting in top counterbore 71''.

Support 129 further includes a rigid housing assembly 141 rigidly secured to plate 130 and straddling slot 134 in the plate. Housing 141 has a top plate 143 which includes a recess groove 113'' (see FIG. 10) in its front edge with a cam face 115'' at the inner end of the groove in top plate 143 being in general axial alignment with slot 134 in plate 130 so that as the bottle 1'' together with the lower and upper bottle supports 135 and 139 together with fitting 53'' installed on the bottle are slid sidewise (i.e., to the right in FIG. 10) from its loading position to its dispensing position, the dome upper face of removable lid 73'' will initially be in register with groove 113'' until such time as the top dome of the removable lid engages cam face 115'' thereby to cammingly force the removable lid 73'' into sealing engagement with the flared sealing end 85'' of diptube 81''. This effectively seals the removable lid relative to the diptube, seals the diptube relative to the fitting body 55'', and seals the upper face of closure cap 15'' to the fitting by means of gasket 67''. It will be understood that the closed end of slot 134 in plate 130 constitutes a stop for preventing further inward movement of the bottle 1'' and fitting 53'' beyond its dispensing position.

As indicated at 145, a gas inlet hose is connected to gas inlet passage 57'' of fitting 53'' and this gas inlet hose in turn is in communication with a gas quick disconnect fitting, as generally indicated at 147, and as is carried by a portion of support 129. Further, a tee 149 is provided in the gas inlet hose 145 such that a pressure relief and pressure release valve 151 is placed in communication with the interior of bottle 1'' when the latter is internally pressurized. It will be understood that pressure relief valve 151 may be generally similar to pressure relief/-release valve 103 heretofore described. Further, a gas inlet hose and coupling, as generally indicated at 153, may be coupled to gas inlet quick disconnect 147 so as to permit pressurization of bottle 1'' in the manner heretofore described in regard to bottle 1.

Further, dispensing system 127 includes a liquid outlet hose 155 connected to removable lid 73'' in a manner similar to hose 111 shown in FIG. 5. This liquid dispensing hose is sealably connected to a liquid dispensing quick disconnect fitting 157 carried by support 129 and a liquid outlet hose and coupling, as generally indicated at 159, may be removably coupled to the liquid quick disconnect fitting 157 in a manner well known to those skilled in the art.

Thus, upon installation of bottle 1'' on lower bottle support 135, upon installation of upper bottle support 139 and fitting 53'', upon puncturing of closure cap 15'' as heretofore described, and upon sliding the bottle together with the lower and upper bottle supports on tracks 136 from the loading position shown in FIG. 10 to its dispensing position in which cam face 115'' applies a substantial downward sealing force on removable lid 73' and on fitting 53'' relative to bottle 1'', the connection of gas inlet hose and coupling 153 to the gas quick disconnect fitting 147 causes pressurized gas to enter the interior of the bottle and to pressurize the contents thereof. Thus, the liquid within bottle 1'' is forced upwardly through diptube 81' and is discharged from fitting 53'' by means of liquid outlet hose 155 to the liquid dispensing hose and coupling 15 via the liquid quick disconnect fitting 157.

It will be understood that with the bottle 1'' under sufficient internal pressurization, a substantial pressure force will act upwardly on fitting 53'' and will be resisted by housing 141 thereby effectively preventing removal of container 1'' from its dispensing position within housing 141 when the bottle is under internal pressurization. However, even if one were to manually begin to withdraw bottle 1'' from its dispensing position, as soon as the domed 77'' upper surface of removable lid 73'' of fitting 53'' moves clear of cam face 115'', the seal will be broken between the removable lid and the flared end of diptube 81'' thus releasing pressure from within the bottle well before the lid 73'' is clear of plate 143.

It will be understood that the primary advantage of the liquid dispensing system 127 for dispensing liquor is that precise volumetric portions of liquor may be accurately and repeatedly dispensed by the pressure dispensing system thus insuring a high consistency and uniformity of mixed drinks. Also, this system insures reliable operation because there are no moving parts, such as pumps, for operation of the system.

In view of the above, it will be seen that the other objects of this invention are achieved and other advantageous results obtained As various changes could be made in the above constructions or methods without departing from the scope of the invention, it is intended that all matter contained in the above description or shown in the accompanying drawing shall be interpreted as illustrative and not in a limiting sense.

We claim:

1. Apparatus for dispensing liquid from a disposable container, said disposable container having a mouth, said apparatus comprising means for withstanding pressurization forces exerted on said container upon internal pressurization thereof, said pressure withstanding means comprising a shroud having a first portion for receiving at least in part a portion of said disposable container and having another portion receiving another portion of said disposable container with said shroud portions being axially movable relative to one another, said pressure withstanding means further comprising a frame for receiving said shroud with said disposable container therein, said frame preventing outward axial movement of said shroud portions beyond a predetermined limit, said shroud including means sealably engagable with said disposable container for admitting pressurizing gas into the interior of said dispoable container and for permitting the dispensing of liquid therefrom, said container having means for permitting elongation and compression within a limited range between a shortest permissible length and a maximum permissible length, said shroud further oomprising means for accommodating a range of lengths of said disposable container, this last said means comprising said shroud portions being telescopic and permitting a disposable container of a shortest permissible length to be readily sealed relative to said means sealably engagable with said container and permitting a container of a maximum permissible length to be compressed in axial direction as said shroud with said container received therein is inserted in said frame so that upon internal pressurization of said container, a positive seal is made between said means sealably engagable with said container and said container.

2. Apparatus as set forth in claim 1 wherein said disposable container has at least transverse ring therearound permitting the ready elongation and compression of said disposable container.

3. Apparatus as set forth in claim 1 wherein said disposable container has means for permitting air to escape from said shroud as said disposable container is inserted therein and for permitting air to enter said shroud as said disposable container is removed from said shroud.

4. A container for transporting a liquid, for insertion into a pressure force withstanding means, and for dispensing liquid therefrom upon internal pressurization of said container when installed in said pressure force withstanding means, said pressure force withstanding means comprising a shroud having telescopic shroud portions receiving said container and supporting the sides of said container against the pressure forces exerted thereon by internal pressurization of said container, said shroud including means sealingly cooperative with said container for internal pressurization thereof and for pressure dispensing of liquid therefrom, said pressure force withstanding means further comprising a frame for receiving said shroud and for restraining said telescopic shroud portions against axial movement beyond a predetermined outer limit, said container having a base, sidewalls, and a mouth substantially opposite said base, said mouth being sealably cooperable with said sealing means, said container having a height from its said base to its said mouth ranging between a predetermined minimum height and a predetermined maximum height such that any container having a height ranging between said maximum and minimum predetermined heights has its mouth in sealingly cooperable relation with said sealing means when said shroud with said container received therein is installed within said frame so as to permit internal pressurization of said container, said container having at least one transverse ring around its sidewalls of a different cross section than its said sidewalls thereby to permit the ready axial compression and elongation of the container.

5. A container as set forth in claim 4 being blow-molded of a suitable synthetic resin, said sidewalls being generally cylindric, said container having a plurality of rings therearound at axially spaced intervals along its sidewalls.

6. A container as set forth in claim 4 wherein said sidewalls are generally cylindric, said container having at least one shoulder above or below said container sidewalls, said shoulder having a diameter larger than the diameter of said container sidewalls, said shoulder having a loose, but sliding sealing fit with the inner surfaces of said shroud as said container is inserted in said shroud, said shoulder having one or more axial slots therein providing communication between the space defined by the outer surface of said container sidewalls and by the inner surface of said shroud and between the space within the shroud thereby to permit air to be exhausted from within said shroud as said container is inserted therein and to permit air to enter said shroud as said container is removed from within said shroud.

7. A container as set forth in claim 6 wherein said axial slots are so structured as to provide air passageways between said container and said shroud so as to permit a container to move from an initially installed position within said shroud to a fully installed position in a length of time ranging between about 0.5–4.0 seconds.

8. A container as set forth in claim 4 having a shoulder above and below said container sidewalls, said shoulders each having a diameter larger than the diameter of said container sidewalls, said shoulders having a loose, but sliding sealing fit with the inner surfaces of said shroud as said container is inserted therein, said shoulders having one or more axial slots therein providing communication between the space defined by said shroud and the bottom of said container thereby to permit air to be exhausted from said shroud as said container is inserted into said shroud and to permit air to enter said shroud as said container is removed therefrom.

9. A container for transporting a liquid for insertion into a pressure force withstanding means, and for dispensing liquid therefrom upon internal pressurization of said container when installed in said pressure force withstanding means, said pressure force withstanding means comprising a shroud having telescopic portions receiving said container and supporting the sides of said container against the pressure forces exerted thereon by internal pressurization of said container, said shroud including means sealingly cooperative with said container for internal pressurization thereof and for pressure dispensing of liquid therefrom, said pressure force withstanding means further comprising a frame for receiving said shroud and for restraining said telescopic shroud portions against axial movement beyond a predetermined outer limit, said container having a base, sidewalls, and a mouth substantially opposite said base, said mouth being sealably cooperable with said sealing means, said base having a portion thereof so structured as to deform upon initial pressurization of said container and to conform to said shroud thereby to form a well in the bottom of said container.

10. A container for transporting a liquid, for insertion into a pressure force withstanding means, and for dispensing liquid therefrom upon internal pressurization of said container when installed in said pressure force withstanding means, said pressure force withstanding means comprising a shroud having telescopic shroud portions receiving said container and supporting the sides of said container against the pressure forces exerted thereon by internal pressurization of said container, said shroud including means sealingly cooperative with said container for internal pressurization thereof and for pressure dispensing of liquid therefrom, said pressure force withstanding means further comprising a frame for receiving said shroud and for restraining said telescopic shroud portions against axial movement beyond a predetermined outer limit, said container having a base, sidewalls, a mouth substantially opposite said base, and a closure closing said mouth, said closure being sealably cooperable with said sealing means, said container having means for permitting the ready axial elongation of said container upon initial pressurization thereof so as to ensure sealing of said closure with said sealing means.

* * * * *